US009877592B2

(12) United States Patent
Farris

(10) Patent No.: US 9,877,592 B2
(45) Date of Patent: Jan. 30, 2018

(54) T-POCKET TOWELS

(71) Applicant: Joe Thomas Farris, Lantana, TX (US)

(72) Inventor: Joe Thomas Farris, Lantana, TX (US)

( * ) Notice: Subject to any disclaimer, the term of this patent is extended or adjusted under 35 U.S.C. 154(b) by 0 days.

(21) Appl. No.: 15/369,376

(22) Filed: Dec. 5, 2016

(65) Prior Publication Data

US 2017/0079445 A1 Mar. 23, 2017

Related U.S. Application Data

(63) Continuation-in-part of application No. 14/467,337, filed on Aug. 25, 2014, now Pat. No. 9,510,713.

(51) Int. Cl.
*A47C 31/11* (2006.01)
*A47K 10/02* (2006.01)

(52) U.S. Cl.
CPC ..... *A47C 31/11* (2013.01); *A47K 10/02* (2013.01)

(58) Field of Classification Search
USPC ..... 297/228.1, 228.11, 228.12, 228.13, 220, 297/229
See application file for complete search history.

(56) References Cited

U.S. PATENT DOCUMENTS 2,441,745 A * 5/1948 Benamy ..... A41B 13/06 15/227
3,111,677 A * 11/1963 Artzt ..... A41B 13/00 2/69.5
4,826,011 A * 5/1989 Jud ..... B65D 75/20 206/484
5,072,467 A * 12/1991 Hunt ..... A47G 9/062 401/201
5,316,337 A * 5/1994 Yamaji ..... B60R 21/231 280/728.1
5,806,925 A * 9/1998 Hanley ..... A47C 31/113 297/219.1
6,192,536 B1 * 2/2001 Connors ..... A47G 9/062 383/4
6,389,597 B1 * 5/2002 Henegan ..... A41B 13/06 2/69.5
7,000,984 B1 * 2/2006 Ward ..... A47C 31/113 297/188.2
2004/0244338 A1 * 12/2004 Nievergeld ..... B29C 65/18 53/451
2008/0267541 A1 * 10/2008 Daelmans ..... B65B 9/20 383/207
2011/0033133 A1 * 2/2011 Kujat ..... B65D 31/10 383/20
2012/0132198 A1 * 5/2012 Hausmann ..... A61M 11/06 128/200.14

* cited by examiner

*Primary Examiner* — David E Allred
(74) *Attorney, Agent, or Firm* — Ferguson Braswell Fraser Kubasta PC; Elizabeth Philip Dahm; Kelly J. Kubasta

(57) ABSTRACT

Various implementations include a towel with a T-pocket and/or a method to sew a "T" pocket into a towel. The pocket in the towel may orient, support and/or secure the towel draped over a seat back or frame structure. The frame structure may be capable being accessibly and removably coupled to suitable objects, such as car seats and other seating having back rests or frames used to display advertising messages or items placed on display resting in the T-pocket. The T-pocket component may include a first end and a longer second end, the longer second end employed to provide a level of protection for the underlying seat and comfort to the seated person, but also allow the person to dry himself and maintain warmth.

26 Claims, 9 Drawing Sheets

T-POCKET TOWELS

CROSS-REFERENCE TO RELATED APPLICATION

This application is a continuation in part of U.S. patent application Ser. No. 14/467,337, entitled "Methods for Sewing T-Pocket Towels" filed on Aug. 25, 2014, which is hereby incorporated by reference.

FIELD OF INVENTION

This invention relates to towels with pockets and sewing patterns to form towels with pockets.

BACKGROUND OF INVENTION

Towels are commonly found in various settings where people work, play and entertain. Towels are used to protect objects from dirt, moisture, cold and wind; used to hide or conceal items or persons; used to dry objects or persons; and, are also used to demonstrate affinity, loyalty or support for teams, brands or products by the color, printed artwork applied or by the shape of the towel.

A towel can be flat. It can also be square, round, rectangle or any other shape. Handles, rings or loops can be attached. Towels can be made of thick and plush fabric, thin and sheer fabric and just about any other combination of known materials.

U.S. Pub. No.: US 2013/0111645 A1 "ATHLETIC APPAREL" provides an article of athletic apparel comprised of different adjacent materials with one of these materials substantially more hydrophilic than the first material. In some implementations, materials are joined using the sewing method described herein yet the types of materials used for the towel will not affect the usefulness of the resulting T-pocket described herein.

U.S. Pat. No. 7,000,984 describes a "BEACH TOWEL CAR SEAT COVER" as an apparatus for a seat cover having a moisture impermeable material and a an absorbent material with strategically placed straps providing means for securing the seat cover to a seat. The type of material and the assembly of these materials will not affect the usefulness of the resulting T-pocket described herein; which, by the design of the T-pocket renders the need for straps obsolete for the purpose of stabilizing the towel when draped over a car seat.

Towels are difficult to secure to objects. Typically, one can use a belt, rope or another towel to tie a towel to an object. As described above, straps have also been used to secure the position of a towel. The towel can also be wrapped or folded upon itself using tension to hold it in place. Or, a towel can be affixed to an object using snaps, buttons or other fasteners affixed to the object to which the towel is secured. The T-Pocket described herein effectively renders these other fastening mechanisms obsolete for the purpose of draping the towel over an object.

U.S. Pat. No. 6,192,536 describes a "WIND RESISTANT BEACH TOWEL". A beach towel made of ordinary, machine washable fabric, together with a plurality of pockets, which may be filled with sand or other material to weigh down the towel is provided. The T-pocket described herein is not a substitute or alternative to the pockets described therein; nor does the T-pocket address the concept of "weighing" down the towel to keep it in place. To the contrary, the T-pocket is s new design which provides a cavity to encompass the shape of an object such as a car seat for retention of position in such situations as described therein.

For example, a "BEACH TOWEL WITH POCKETS" is presented in U.S. Pat. No. 5,072,467. Beach towel has envelopes attached there to so as to create closeable envelopes on the towel and pockets behind the envelope. The envelopes and/or pockets can be used for storing needed items such as sunscreen lotion, clothing items, or entertainment items such as a book or radio. The envelopes and/or pockets can alternatively be used as a receptacle for sand in order to hold down the beach towel and form a pillow. The T-pocket described herein is not a container pocket as described therein. While the T-Pocket does form a "bucket" or "bowl" when draped over a frame assembly in which objects can be placed for display, storage and collection, the "bucket", "bowl" or "cavity" that is described more below has uses which are more suited to situations like easily displaying candy, coupons, trinkets and the like.

SUMMARY OF INVENTION

The following presents a simplified summary in order to provide a basic understanding of some aspects of the disclosed invention. This summary is not an extensive overview, and it is not intended to identify key/critical elements or to delineate the scope thereof. Its sole purpose is to present some concepts in a simplified form as a prelude to the more detailed description that is presented later.

To resolve the problems mentioned above, in some implementations a method to sew the opposing edges of a typical towel in the form of a "T" to create a pocket or cavity is provided. The particular technique creates perpendicular seams that form the "T" shape, which when sewn, forms a pocket on the sewn end of the towel.

The sewing technique is may be used instead of using zippers, loops and rings, snaps or eyelets and string. Sewing eliminates the use of metal or plastic fittings that may scratch, tear or mark fabrics or materials such as wood finishes or leather coverings. Sewing the seams also eliminates some noise and the potential for scratching the finish in washing machines or dryers from the metal or plastics fittings. Sewing also eliminates the potential for burning the skin which may result from using the towel outdoors in sunlight for extended hours, whereby metal or plastic fittings could get hot and burn the skin when touched.

In some implementations, a pocket is provided which will support the towel when the towel is draped over an object, thus allowing the towel to remain in position. Such objects can include car seats, lounge chairs, or any similar back rest. When the towel is draped over a frame structure with a void underneath the horizontal plane defined by the interior space surrounded by the frame members, the pocket will droop within the void space creating a "pocket" or "cavity" in which items can be placed for display or containment.

In some implementations stability is provided in position of the towel when draped over a back rest or supporting frame whereby the long face of the towel is suspended allowing the user to apply images or words to the fabric which are displayed as a result of the towel positioning facing outward. This is particularly important for users that want to advertise a brand or message using the towel when draped over a chair, car seat or other similar back rest structure.

In some implementations, systems may include a sewing technique which attaches the opposing sides of one end of a towel to form a "T" pattern, which in turn forms a pocket.

The manner in which the edges are attached in the "T" shape of the differ from a single seam "hood" formed by sewing the edges of the end of a towel to each other from the outer most edge to the mid-point of the edge of a towel. In some implementations, the seam is started from the outer most corners placed back to back of the edge of the towel and sewn a length less than to the mid-point. For the remaining span, the remaining span is sewn to the opposing side of the same edge segment. This differentiation forms the "T" shape which in turn forms the seam along the top of the pocket which provides for stability, orientation and support not found in other "hood" or cavity designs.

The towel which is made of fabric material, for instance machine washable terry cloth provides adequate support to sew a seam to form the "T" pocket. The materials used in the fabric and thread are durable, easily manipulated and coated or formed of materials that reduce the likelihood of causing damage to the objects or persons over which the towel is draped. The materials selected to form the towel may also include properties which provide for the application of ink, stencils or other applied markings which allow the towel to be positioned as a form of advertising when draped over a chair, seat, frame or worn over the head or shoulders of a person.

Embodiments of the present disclosure generally may provide seat-covering systems that not only provide a level of protection for the underlying seat and comfort to the seated person, but also allow the person to dry himself and maintain warmth.

In another embodiment, the present disclosure may provide a seat-covering system comprising a hood-like component to accessibly and removably couple to a seat. The hood component may comprise a cape-type feature.

In some implementations, the described systems may include provides carry, storage and transport of the towel in a simple and efficient way: The first the "T" shape of pocket provides a default orientation when the towel is spread flat. Using this orientation, a person can fold the long edges of the towel according to the span of the "T" pocket and then continue folding intermediate sections of the towel starting from the lower unsewn edge of the towel towards the sewn edge of the towel and once folded, tuck the towel underneath the T-pocket for storage. Once complete folded, the T-Pocket retains the shape of the folded towel for display, stacking multiple towel side-by-side or vertically in a stack. These alternate applications provides users more convenient alternatives when using the towel.

Still other objects of the present invention will become readily apparent to those skilled in this art from the following description wherein there is shown and described the embodiments of this invention, simply by way of illustration of the best modes suited to carry out the invention. As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION

In the following description, for purposes of explanation, numerous specific details are set forth in order to provide a thorough understanding of the claimed subject matter. It may be evident; however, that the implementations may be practiced with or without any combination of these specific details, without departing from the spirit and scope of this invention and the claims.

Embodiments of the present disclosure generally may provide seat-covering systems that provide a level of protection for the underlying seat, comfort to the seated person, and/or allow the person to dry himself and maintain warmth.

Figure 2:
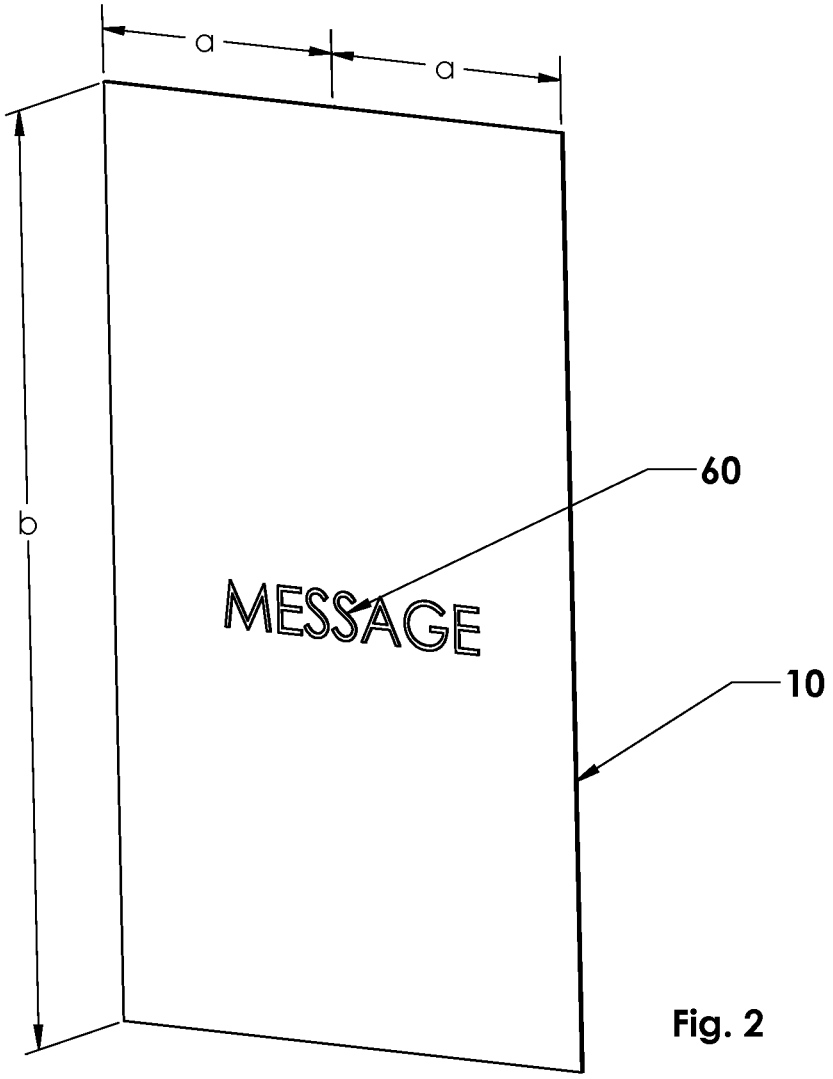
FIG. 2 is an exemplary illustration of flat towel from which the method for sewing the T-pocket is applied in accordance with the embodiments of the present disclosure.

FIG. 2 depicts a preformed a typical rectangular towel system 10. In one embodiment, system 10 may have a width (w) measuring about 40 inches represented by two segements of measure "a" and a length (I) measuring about 70 inches represented by one measure "b". In such embodiments, the width (2×a) and length (b) may be varied. In those embodiments, the T-pocket is not restricted by the variances of width (2×a) to length (b) nor is the method used to form the "T" determined by the length (b) measurement.

Figure 3:
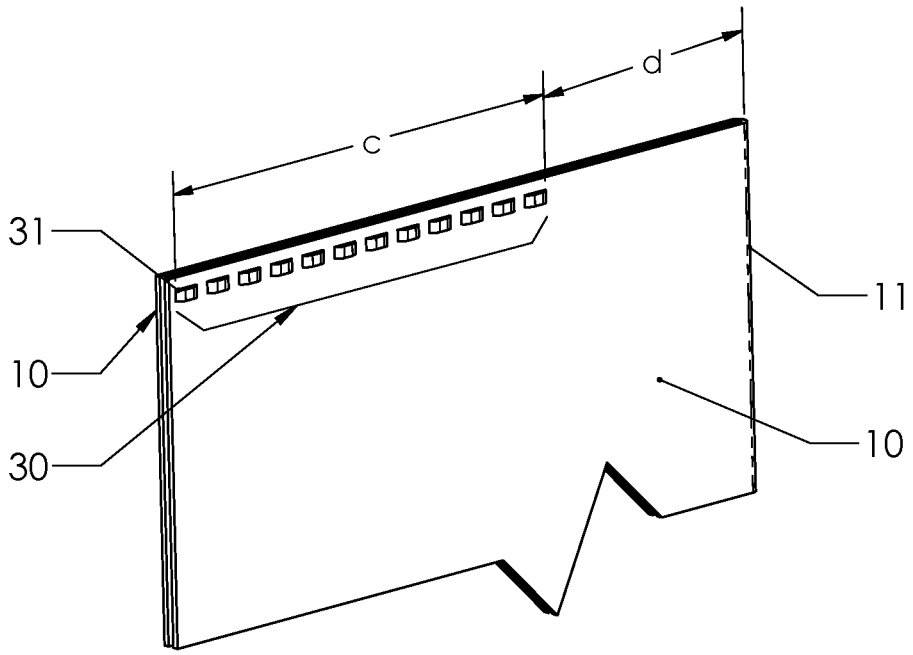
FIG. 3 is an perspective view of the towel in FIG. 2 folded vertically exposing the back face of the towel and the horizontal edge seam which forms the base of the T-pocket of FIG. 1 in accordance with embodiments of the present disclosure.

FIG. 3 depicts the base seam of the T-pocket. In an embodiment of the present disclosure, the base seam system 30 may be formed by folding system 10 in half along the midpoint edge shown as 11 with the front or right-side out surfaces inward and opposing each half. Individual stitches 31 are applied along the span 30 of the top edge of folded system 10. The span length is measurement (c) which is approximately two-thirds the measurement of span (a)

shown in FIG. 2. The remaining span (d) is approximately one-third the measurement of span (a) shown in FIG. 2. When the seam system 30 is completed, the base seam of the T-pocket is formed.

Figure 4:
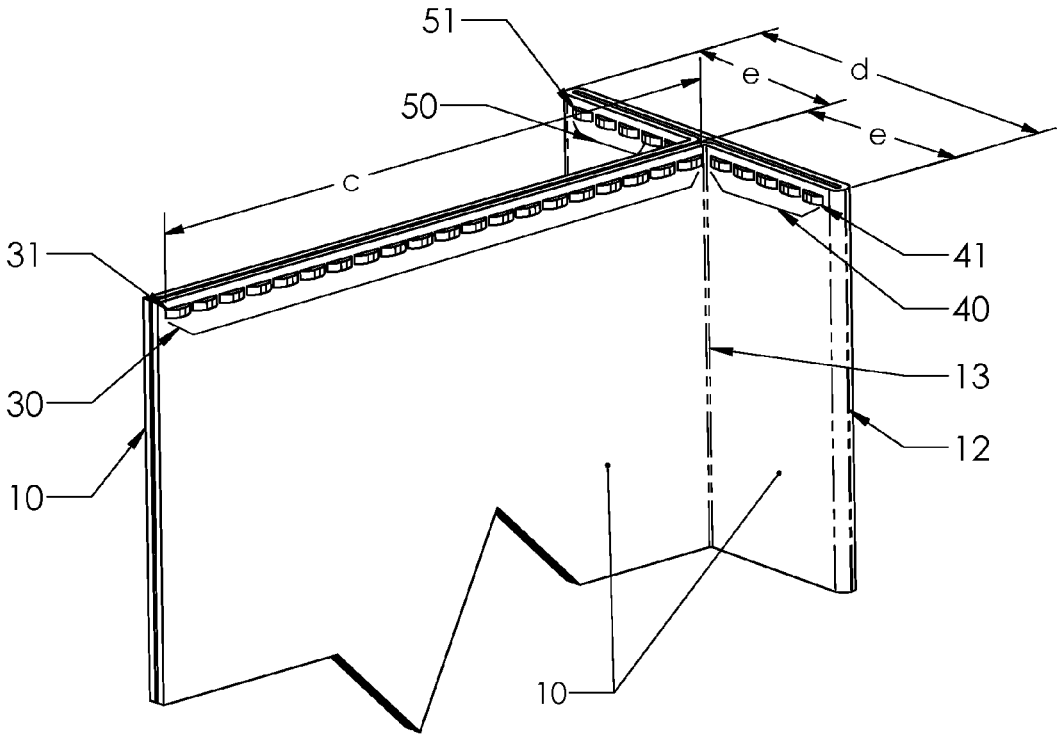
FIG. 4 provides an exemplary illustration of the sewn towel in FIG. 3 with the perpendicular edge seam which forms the top of the T-pocket of FIG. 1 in accordance with embodiments of the present disclosure.

FIG. 4 depicts the top seam of the T-pocket. In an embodiment of the present disclosure, the top seam systems 40 and 50 may be formed by folding system 10 again along the perpendicular plane to the base seam 30. Span (d) is folded in half so that the midpoint of span (d) meets the interior end point of seam 30. Individual stitches 41 and 51 are applied along the spans d left and right along the top edge of folded system 10. The span length is measurement (d) which is approximately one-third the measurement of span (a) shown in FIG. 2 and is formed with two equal left and right segments measure (e). The left and right spans (e) are approximately one-half the measurement of span (d) shown in FIG. 4 and one-sixth the measurement of span (a) shown in FIG. 2. When the seam systems 40 and 50 are completed, the top seam of the T-pocket is formed, this forms the competed T-pocket seam.

In alternative embodiments, seam 30, 40 and 50 may be formed any suitable manner, such as being bonded, glued, stapled, or any other suitable coupling method including using hook-and-loop fasteners, zippers, buckles, button, snap-button, adhesive, permanent adhesive, peel-and-stick material, male and female coupling adapters, other suitable coupling materials, or any combination thereof.

Figure 1:
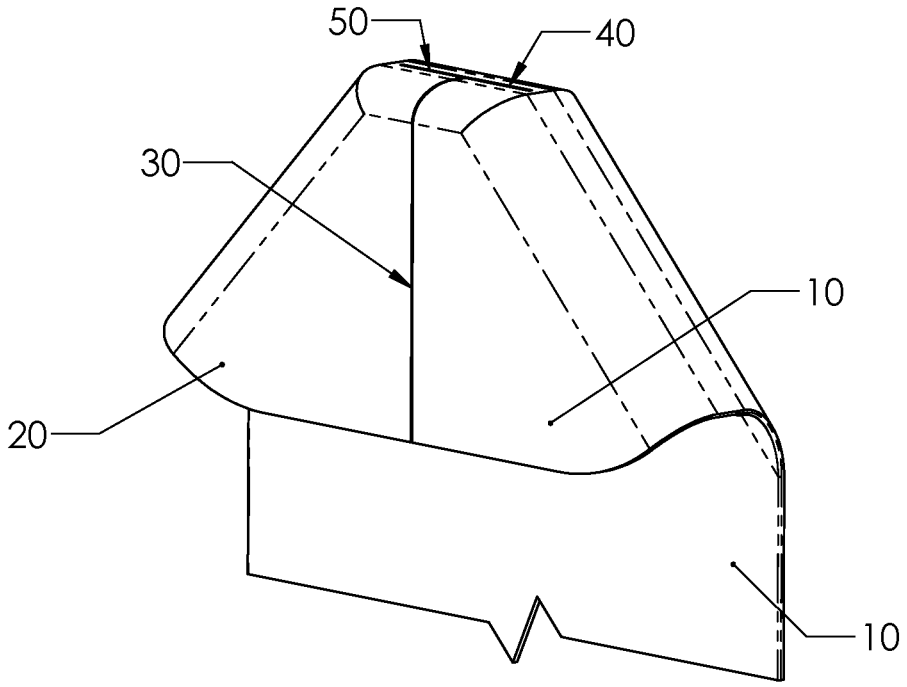
FIG. 1 is an exemplary illustration of a back view of the T-pocket in accordance with embodiments of the present disclosure.
Figure 5:
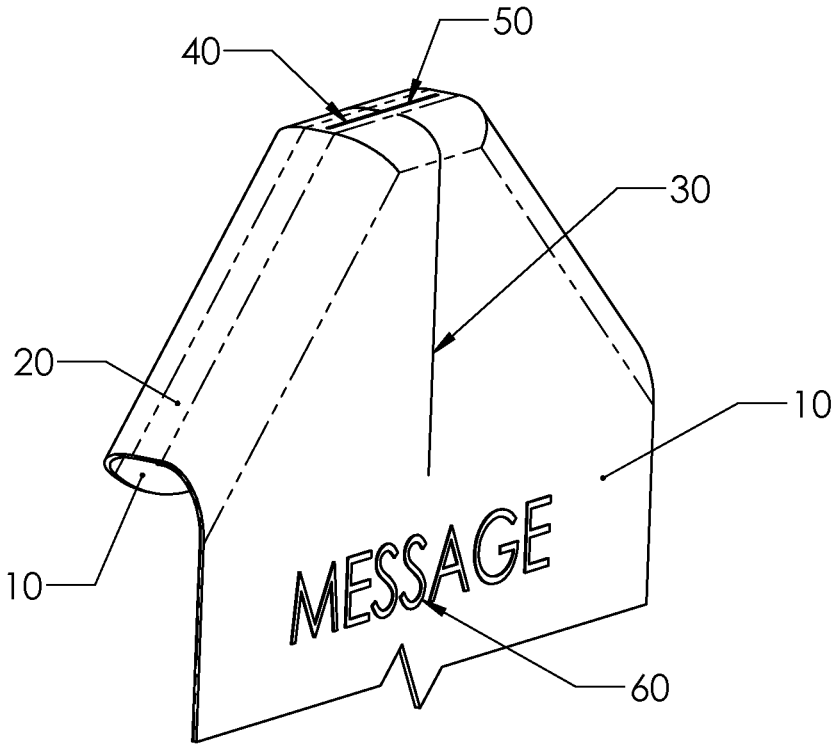
FIG. 5 provides an exemplary illustration of the sewn towel in FIG. 4 turned right-side out and forward facing opposite as shown in FIG. 1 in accordance with embodiments of the present disclosure.

FIG. 1 and FIG. 5 generally illustrate the T-pocket system 20. FIG. 1 illustrates the back face of system 20 and FIG. 5 illustrates the front face of system 20. It should be understood that system 20 shown in FIG. 1 and FIG. 5 is for illustrative purposes only and that any other suitable system or subsystem could be used in conjunction with or in lieu of system 20 according to one embodiment of the present disclosure.

System 20 may generally include hood-like component as depicted in FIGS. 1 and 5. Alternatively, system 20 may include a pocket-like component as depicted as 70 in FIG. 6.

In an embodiment of the present disclosure, hood-like component may be employed to accessibly and removably couple system 20 to an object, such as a seat. A pocket-like component may be employed to accessibly and removably couple system 70 to an object, such as a frame assembly.

In operation, hood-like component system 20 may be coupled to an object, such as a seat back, by lifting hood-like component system 20 over the seat back and then hooding the seat back with hood-like component system 20, such that first end with systems 40 and 50 engages the back of the seat back. In such an orientation, the longer second end of system 10 substantially covers the seat with system 60 displayed if applied to system 10, thereby providing a layer of protection between the seat and a seated person.

Figure 6:
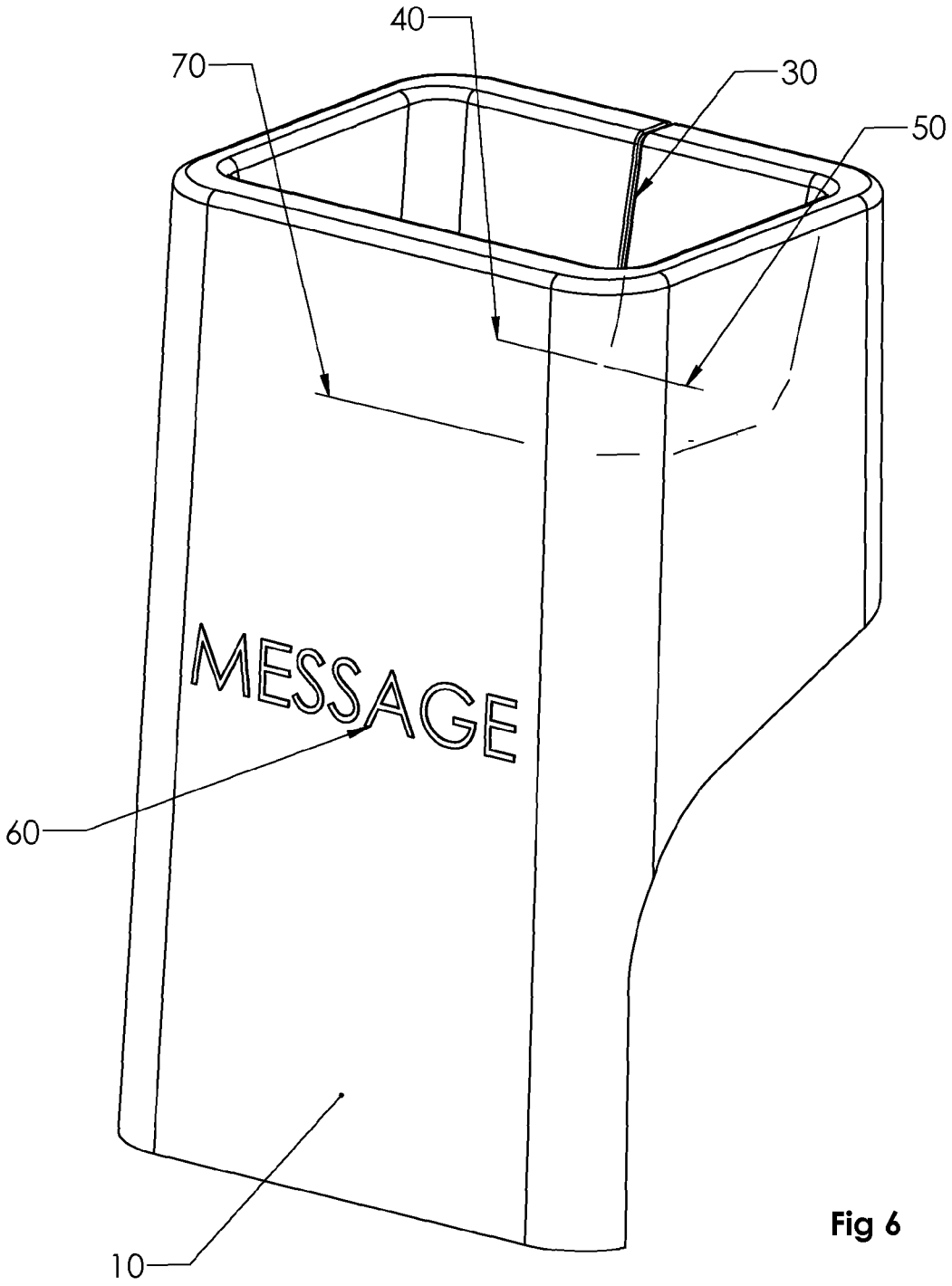
FIG. 6 is a perspective view of the completed T-pocket draped suspended in space to illustrate how the T-pocket will droop into the cavity created by the void of a frame structure for displaying the message or images applied to the front face of the towel and creating a pocket to hold items for display in accordance with the embodiments of the present disclosure.

In alternate operation shown in FIG. 6, pocket-like component system 70 which is essentially hood-like system 20, FIG. 1 inverted, may be coupled to an object, such as a frame assembly, by laying pocket-like component system 70 over the frame assembly and then allowing the system 10 sewn with the T-pocket seams 30, 40 and 50 to droop into the void formed by the frame assembly, such that first end with systems 30, 40 and 50 of system 10 engages the frame assembly. In such an orientation, the pocket-like system 70 of system 10 substantially covers the frame and forms the pocket, while the long end of system 10 is suspended from the top of the frame assembly and allowed to hang from the frame assembly with system 60 displayed if applied to system 10, thereby providing a display of system 10 along with system 60.

In one embodiment, hood-like component system 20 or pocket-like system 70 may stretch and expand so as to accommodate objects with varying size and shape. In other embodiments, hood-like component system 20 may compress and tightly secure itself around smaller objects, such as the seat back of a stadium seat. Pocket-like system 70 may stretch and become more shallow or compress and have more depth.

Once coupled with an object, hood-like component system 20 or pocket-like system 70 may remain securely in place as a result of seams 30, 40 and 50, which may allow for ample enclosure of an object within hood-like component system 20 or enclosure of an object within pocket-like system 70.

Figure 7A:
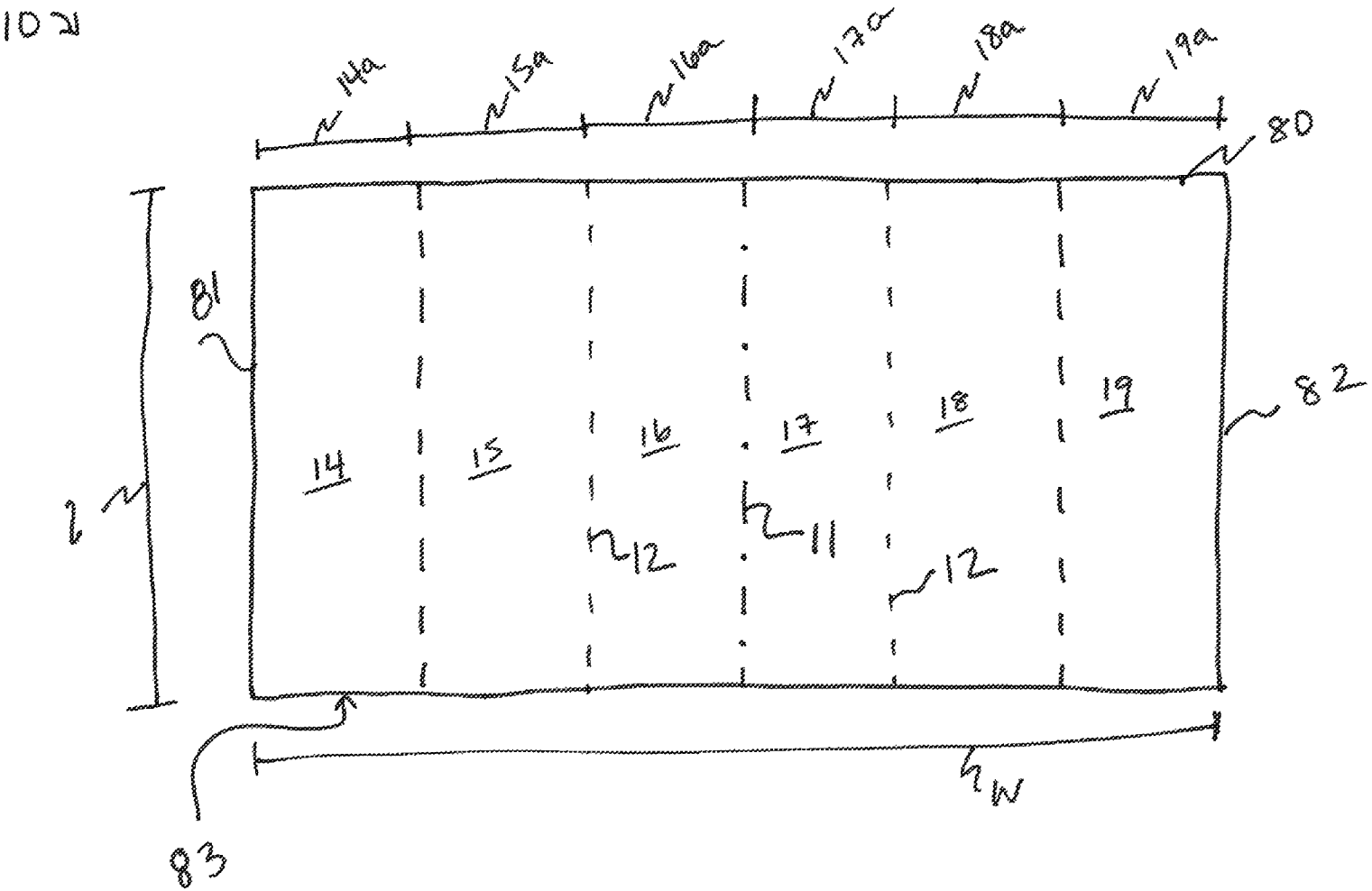
FIG. 7A illustrates a front view of an implementation of a length of fabric.

FIG. 7A illustrates an implementation of an example length of fabric of the system 10. Although the fabric is illustrated as rectangular in shape, any appropriate size and/or shape of fabric may be utilized. Although the length, l, of the fabric is illustrated as shorter than the width, w, the length of the fabric may be equal to or greater than the width of the fabric. The system 10 may include a first end 80 and a second opposing end 83. The pocket may be formed proximate the first end 80, in some implementations. The system 10 (e.g., towel) may include a first side 81 and a second opposing side 82. The system 10 may include a first surface (e.g., the surface visible in FIG. 7A) and an opposing second surface. In some implementations, the inner surface of the pocket may include the first surface and the outer surface of the pocket may include the second surface. The second surface may include images and/or text (e.g., advertising, logo, monogram, custom message, etc.).

As illustrated, the system 10 may include a first part 14, a second part 15, a third part 16, 17, a fourth 18, and a fifth part 19. The first part 14 may be disposed proximate the first side 81 and the fifth part 19 may be disposed proximate the second side 82. The second part may be disposed between the first part 14 and the third part 16,17. The fourth part may be disposed between the third part and the fifth part 19.

The third part may include includes two portions, a first portion 16 and a second portion 17. In some implementations, the midpoint 11 of the width of the fabric may be in the third portion and/or the boundary between the first portion 16 and the second portion 17 of the third part. The boundary or a portion thereof between the second part and the third part may form an edge 12 of the pocket. The boundary or a portion thereof between the fourth part and the third part may form an edge 12 of the pocket.

The first portion 16 and the second portion 17 of the third part may be the same size and/or different sizes. For example, when the first portion 16 and the second portion 17 are different widths, the second seam and the third seam may be different lengths and thus the first seam may reside off-center (e.g., with respect to the second seam and the third seam). The off-center implementation may be utilized in some applications (e.g., to avoid interference of the first seam and a portion of a seat or car, to protect an edge of a seat, etc.).

Figure 7B:
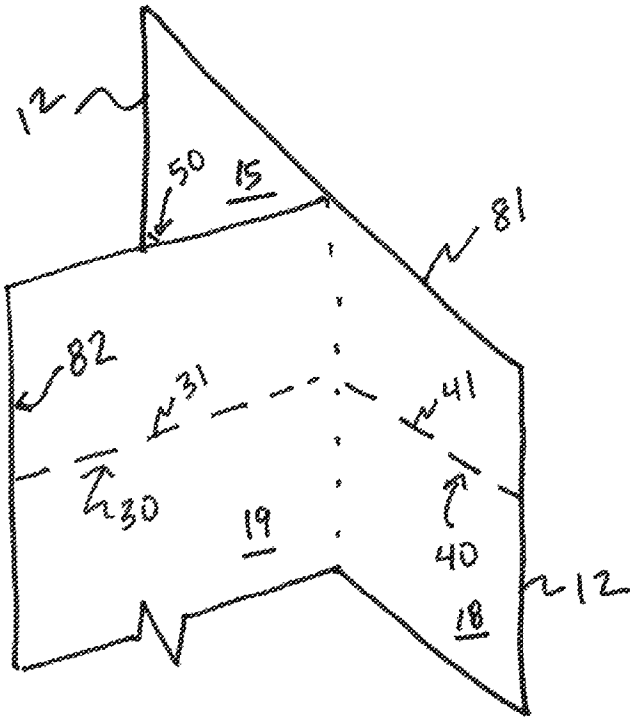
FIG. 7B illustrates an implementation of a T-pocket formed in a length of fabric.
Figure 8C:
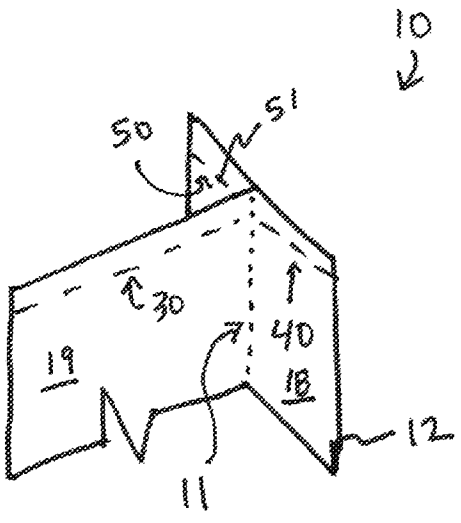
FIG. 8C illustrates an implementation of a T-pocket formed in a length of fabric.
Figure 8B:
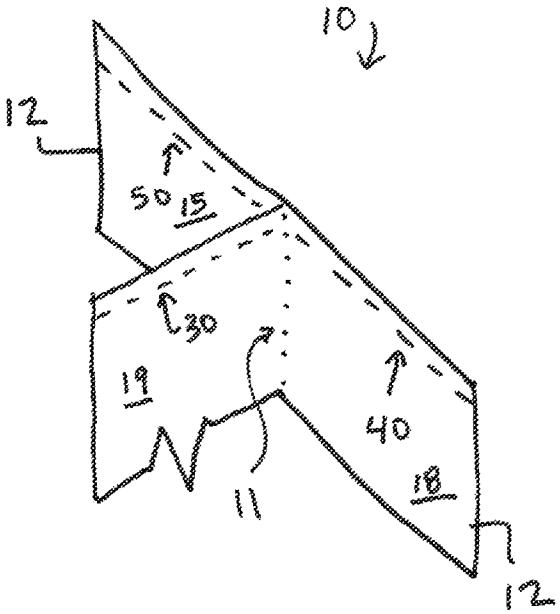
FIG. 8B illustrates an implementation of a T-pocket formed in a length of fabric.
Figure 8A:
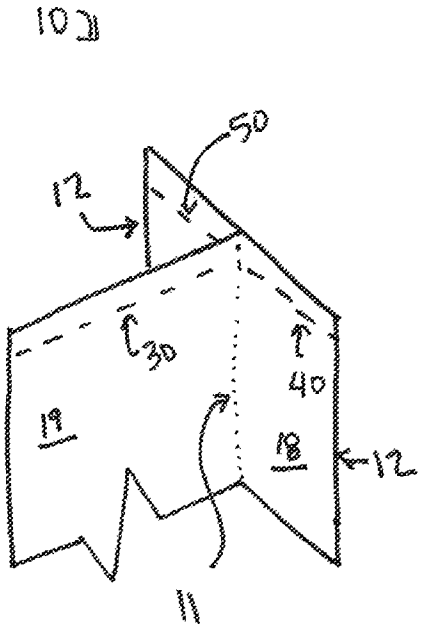
FIG. 8A illustrates an implementation of a T-pocket formed in a length of fabric.

The width of each part (e.g., parts 14-19) may be similar or different. For example, the first part, the second part, the fourth part, and the fifth part may have similar widths, as illustrated in FIG. 7B. As illustrated in FIGS. 8A-8C, the widths of each part may be different. A width of one or more parts may be selected based on the application of the towel. For example, a first towel to be used as a seat cover for a truck may have a second part with a width greater than a width of a second part of a second towel that is to be utilized as a seat cover for a car. As illustrated in FIG. 8C, a width of a pocket (e.g., the second seam and the third seam) may be approximately the same as a length of the pocket (e.g., first seam). The width of the pocket created (e.g., the second seam and the third seam) may be greater than the length of the pocket (e.g., first seam) as illustrated in FIGS. 8A and 8B. For example, when utilizing the towel with a beach chair, the headrest (e.g., top portion) of the beach chair may be wide and rectangular (e.g., when compared with a car seat headrest). Thus, a towel with a wider pocket may be created (e.g., when compared with a towel for covering at least a portion of a car seat).

In some implementations, the towel may be created with a deeper pocket (e.g., when compared with a car seat). The deeper pocket may facilitate use in beach settings to allow more sand to be disposed in the pocket and/or allow the pocket filled at least partially with sand to be buried deeper (e.g., when the pocket is used as an anchor), The third part may have a width that is approximately equal to the combined width of width the second part and the fourth part.

In various implementations, the first part may be coupled with the fifth part of a length of fabric by a first seam. The second part may be coupled to the first portion of the third part by a second seam, and a fourth part may be coupled to the second portion of the third part by a third seam. The first seam, second seam, and third seam may form an approximately T-shape in the towel. The first seam, second seam and/or third seam may have any appropriate shape. The first seam, second seam, and/or third seam be approximately straight, in some implementations. In some implementations, as illustrated, a first end of a first seam may be disposed proximate a first end of a second seam and first end of a third seam. A second end of the first seam may be disposed proximate sides of the length of fabric (e.g., towel).

The first seam, second seam and third seam may form a pocket as illustrated in FIGS. 1, 5, and 6. The pocket may be approximately trapezoidally shaped in some implementations. For example, the pocket may include an approximately flat portion that includes the second seam and the third seam. The pocket may flare out at an angle from a second end of the second seam and/or third seam towards an edge of the towel. The second seam and the third seam may form an approximately planar portion that extends from the second seam and the third seam, in some implementations. In some implementations, a first area may reside on the first surface of the fabric proximate the cavity formed by the pocket. The first area may reside on a different plane than the plane formed by the second seam and the third seam when the pocket is disposed over a headrest (e.g., of a car seat, chair, etc.).

The first seam, second seam, and third seam may be disposed proximate an end of the length of fabric as illustrated in FIGS. 3 and 4 and/or may be disposed a distance from an end of the length of fabric as illustrated in FIG. 8B.

The length of the towel, cushioning provided by the pocket, and/or absorbency provided by the towel may be adjusted by adjusting the position of the seams (e.g., distance from an end of the fabric at which the first seam, second seam, and third seam are disposed). For example, more fabric may be disposed in the pocket when the first seam, second seam and third seams are disposed at a distance from an end of the length of fabric (e.g., as opposed to proximate the end of the length of the fabric). The excess fabric may provide cushioning on a head rest (e.g., portion on which a person's head may be positioned proximate when sitting on the chair) and/or increase absorbency. For example, a user may be utilized the towel over a car seat to protect the car seat after a bike ride. Sweat, dirt and/or other fluids may be absorbed by the towel and/or the pocket. In some implementations, the excess fabric in the pocket may facilitate absorption of sweat and/or other fluids.

System 10 may be coupled to seats having backs, such as, for example, car seats, beach chairs, stadium seats, airplane seats, house chairs, sofa chairs, patio chairs, lounge chairs, other suitable seats, or a combination thereof. System 10 may also be coupled to frames having square, rectangle, round, conical or triangular voids such as tubes, pipes, canisters, bowls, basins, or a combination thereof.

Hood-like component system 20 or pocket-like component system 70 may also be employed to accessibly and removably couple system 10 to any other suitable object.

In one embodiment of the present disclosure, system 10 may be employed to clean water, sand, dirt, rain, mud, snow, and/or sweat off of a person, while protecting a seat or other suitable object from becoming dirtied.

In another embodiment, system 10 may be employed as a protective barrier for a seated person against a dirty chair.

In alternative embodiments, a non-seated person may employ system 10 as a hooded cape to dry and warm himself.

In alternative embodiments, system 10 may be employed as a message board as a form of advertising.

In alternative embodiments, system 10 may be employed as a display container to hold items for display, give-a-way or for sale.

In various implementations, a t-shaped sewing pattern to form a hood-like or pocket like component may provided. The sewing pattern may be implemented on a length of fabric, such as a towel, and may close an end of the fabric. The sewing pattern may include a single segment base seam, two segment top seam, where the base seam and the top seam have perpendicular orientations with respect to each other.

In various implementations, a car seat protector may be provided. The car seat protector may include a towel and a t-shaped sewing pattern sewn into the towel. The t-shaped sewing patter may form a hood from one end of the towel and have a base seam perpendicular to two connected top seams. The hood may have an opening (e.g., a cavity disposed in the hood). In some implementations, the car seat protector may include an advertising message and/or image applied to a front side of the towel (e.g., second side).

In various implementations, a display towel may be provided. The display towel may include a towel and a t-shaped sewing pattern. The T-shaped sewing pattern may be sewn in the towel to form a pocket in one end of the towel, where the pocket includes an opening (e.g., a cavity in the pocket). The sewing pattern in the towel may include a base seam perpendicular to two connected top seams. In some implementations, the car seat protector may include an advertising message and/or image applied to a front side of the towel (e.g., second side).

Any of hood-like component system 20 or pocket-like system 70, system 10 may be made of terry cloth, terry cloth like material, towel-like material, bamboo, silver impregnated material, carbon impregnated material, other materials having natural properties, other materials having infused antimicrobial properties, cotton, polyester, cloth, canvas, jute, hemp, sisal, fiber, natural fiber, synthetic fiber, other suitable material, or any combination thereof.

In one embodiment, the exterior surface of any of hood-like component system 20, pocket-like system 70, system 10, seams 30, 40 50, and stitches 31, 41 and 51 may be embellished with different colors, patterns, camouflage patterns, patches, fabric paint, novelty items, ornamental items, stickers, removable stickers, text, logos, designs, images, other embellishments, other decorative materials, or any combination thereof to enhance or otherwise achieve a desired design.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

The invention claimed is:

1. A backrest cover made of a towel material, the backrest cover comprising:

a length of fabric comprising:

a first part;

a second part;

a third part;

a fourth part; and a fifth part;

wherein the first part and the fifth part are disposed on opposing sides of the length of fabric, and wherein the second part is disposed between the first part and the third part, and wherein the fourth part is disposed between the third part and the fifth part;

a first seam coupling the first part and the fifth part;

a second seam coupling the second part and a first portion of the third part;

a third seam coupling the fourth part and a second portion of the third part, wherein the second seam and the third seam define a line extending transversely to the first seam to form a T-shape; and a pocket formed by the first seam, the second seam and the third seam, the pocket forming a seat back cover configured for placement on a seat back.

2. The backrest cover of claim 1 wherein a width of the first part is approximately the same as a width of the second part of the length of fabric.

3. The backrest cover of claim 1 wherein a width of the first part is greater than a width of the second part of the length of fabric.

4. The backrest cover of claim 1 wherein a width of the first part is less than a width of the second part of the length of fabric.

5. The backrest cover of claim 1 wherein a width of the second part and a width of the fourth part are not the same.

6. The backrest cover of claim 1 wherein at least one of the second seam or the third seam is disposed on a different plane than a first area when the pocket of the seat back cover is disposed on a seat.

7. The backrest cover of claim 1 wherein the second seam and the third seam are configured to be disposed on a different plane than at least a portion of the first seam when the pocket of the cover is disposed on a backrest.

8. The backrest cover of claim 1 wherein the towel is capable of coupling to a seat to at least partially cover the seat.

9. The backrest cover of claim 1 wherein the pocket is capable of stretching.

10. The backrest cover of claim 1 wherein the pocket is approximately trapezoidal.

11. The backrest cover of claim 1 wherein the first seam, the second seam and the third seam are disposed proximate an end of the length of fabric.

12. The backrest cover of claim 1 wherein the first seam, the second seam, and the third seam are disposed at a distance from an end of the length of fabric.

13. The backrest cover of claim 1 wherein the pocket formed is capable of covering at least a portion of a head rest of a chair, and wherein the chair is at least one of a car seat, beach chair, stadium seat, airplane seat, house chair, sofa chair, patio chair, or lounge chair.

14. A seat cover comprising a T-shaped pattern of seams to form a hood or pocket component in a towel, the seat cover comprising:

a first seam, wherein the first seam couples a first part and a fifth part of a length of fabric, wherein the first part and the fifth part are disposed on opposing sides of the length of fabric;

a second seam; wherein the second seam couples the second part of the length of fabric and a first portion of the third part of the length of fabric, wherein the second part is disposed between the first part and the third part;

a third seam, wherein the third seam couples the fourth part of the length of fabric and a second portion of the third part of the length of fabric, and wherein the fourth part is disposed between the third part and the fifth part;

wherein the second seam and the third seam define a line extending transversely to the first seam to form a T-shape;

and wherein a pocket is formed in the length of fabric by the first seam, the second seam, and the third seam, the pocket forming a seat cover configured for placement on a chair or seat.

15. The seat cover of claim 14 wherein the first seam, the second seam and the third seam are disposed proximate an end of the length of fabric.

16. The seat cover of claim 14 wherein the first seam, the second seam, and the third seam are disposed at a distance from an end of the length of fabric.

17. The seat cover of claim 14 wherein the pocket formed is capable of covering at least a portion of a head rest of a chair, and wherein the chair is at least one of a car seat, beach chair, stadium seat, airplane seat, house chair, sofa chair, patio chair, or lounge chair.

18. The seat cover of claim 14 wherein a width of the first part is approximately the same as a width of the second part of the length of fabric.

19. The seat cover of claim 14 wherein a width of the first part is greater than a width of the second part of the length of fabric.

20. The seat cover of claim 14 wherein a width of the first part is less than a width of the second part of the length of fabric.

21. The seat cover of claim 14 wherein a width of the second part and a width of the fourth part are not the same.

22. The seat cover of claim 14 wherein at least one of the second seam or the third seam is disposed on a different plane than a first area when the pocket of the cover is disposed on a seat.

23. The seat cover of claim 14 wherein the second seam and the third seam are configured to be disposed on a different plane than at least a portion of the first seam when the pocket of the seat cover is disposed on a backrest.

24. The seat cover of claim 14 wherein the towel is capable of coupling to a seat to at least partially cover the seat.

25. The seat cover of claim 14 wherein the pocket is capable of stretching.

26. The seat cover of claim 14 wherein the pocket is approximately trapezoidal.

* * * * *